United States Patent [19]

Craig, Jr.

[11] 4,003,573

[45] Jan. 18, 1977

[54] AMUSEMENT BALL FOR BOUNCING

[76] Inventor: Edward A. Craig, Jr., 2696 Kenwyck Drive, Troy, Mich. 48084

[22] Filed: Jan. 2, 1976

[21] Appl. No.: 645,959

[52] U.S. Cl. ..... 273/58 K; 46/211

[51] Int. Cl.[2] ..... A63B 37/12; A63B 43/00

[58] Field of Search ..... 273/58 K, 223, 128 R, 273/128 A, 58 A, 58 D; 46/211; 40/327

[56] References Cited

UNITED STATES PATENTS

| | | | |
|---|---|---|---|
| 726,471 | 4/1903 | Smith | 273/223 |
| 917,658 | 4/1909 | Reach | 273/58 K |
| 3,885,795 | 5/1975 | Brewer | 273/58 K |

*Primary Examiner*—George J. Marlo
*Attorney, Agent, or Firm*—Whittemore, Hulbert & Belknap

[57] ABSTRACT

The ball is generally egg-shaped. The entire surface of the ball is covered with randomly oriented ridges and valleys. When the ball is thrown against a hard surface, it will bounce erratically, changing direction radically each time it hits the hard surface.

2 Claims, 2 Drawing Figures

AMUSEMENT BALL FOR BOUNCING

BACKGROUND OF THE INVENTION

Figure 1:
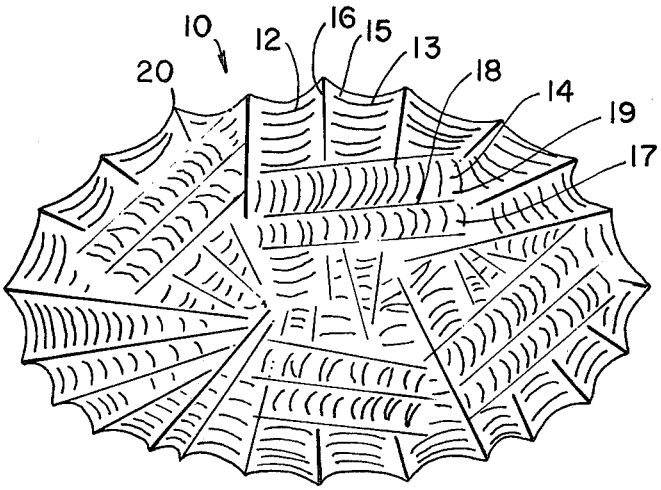

Historically, balls of various descriptions have been provided to play various types of games. In the main, such prior art balls have had a generally spherical shape so that when they are hit, thrown, caught or bounced, the reaction of the ball is predicable regardless of what angle the ball is deployed.

The predicable nature of such prior art balls is somewhat boring to children under the age at which they are capable of playing structured games such as baseball, soccer, and the like. In accordance with the present invention, a ball is provided with randomly oriented elongated ridges and grooves on the surface thereof which results in the ball bouncing in an erratic and unpredicable path when it is thrown against a hard surface. Such erratic, unpredicable behavior is capable of maintaining the interest of a young child for a longer period of time than is the case in connection with the conventional spherical shaped ball.

SUMMARY OF THE INVENTION

The ball is fabricated of an elastomeric material for the purpose of bouncing. The surface of the ball is entirely covered with a plurality of elongated ridges and grooves which are randomly oriented in different directions. Each ridge defines an elongated peak which, when it strikes a hard surface, will dictate the direction of the bounce of the ball. The peaks are relatively sharp. The peaks are spaced apart a distance of from about 3/16 inch to ¼ inch. The ball has a generally egg-shape configuration.

IN THE DRAWING

Figure 2:
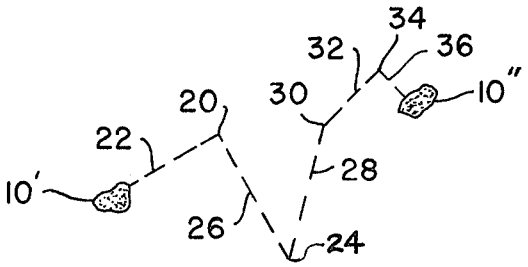

FIG. 1 is a side elevational view of one embodiment of a ball in accordance with the present invention; and FIG. 2 is a diagrammatic view of a possible course of bouncing of the ball when thrown against a hard surface such as a floor.

Referring to FIG. 1, it will be noted that the ball 10 has a generally egg-shape configuration. This egg-shape enhances the erratic bouncing of the ball as is well known in the case of the American football. The shape is not, however, primarily responsible for the erratic bouncing of the ball.

The ball is fabricated of conventional rubber or rubber-like substance, generally termed "elastomeric" which are generally known in the art for fabricating balls which are intended to bounce when thrown against a hard surface.

The entire surface of the ball 10 is covered with randomly oriented elongated ridges and valleys. As will be noted, for example, the valleys 12, 13 and ridge 15 are oriented substantially vertically as displayed in FIG. 1 while the valleys 14, 17 and ridge 19 are oriented substantially horizontally as viewed in FIG. 1. Thus the peaks 16, 18 are also oriented, respectively, substantially vertically and substantially horizontally as viewed in FIG. 1. It is this difference in orientation which results in the erratic bouncing behavior of the ball 10. It is virtually impossible for the ball 10, when thrown against a hard surface such as a floor, to successively impinge the same peak against the hard surface to result in bouncing two times in the same direction. Thus the ball, each time it hits the hard surface, bounces in a different direction creating an amusing erratic travel.

The peaks should not be too close together or too far apart or else the desired erratic behavior will not be obtained. It is preferred that the peaks not be more than about ¼ inch apart or closer together than about 3/16 inch.

It is preferred that the peaks of the ridges define a substantially sharp edge as illustrated in FIG. 1, for example, at 20. Such a sharp edge results in the ball bouncing in a drastically different direction each time it hits a hard surface. In some instances, the ball will in fact absolutely reverse direction and bounce back towards the person who threw it.

FIG. 2 illustrates one possible course the ball 10 might take when thrown against a hard surface. FIG. 2 assumes that one is looking down upon a hard surface such as a floor. 10' illustrates the ball being thrown towards the point 20 along dotted path 22. When the ball hits point 20, it bounces towards point 24 along path 26 which is illustrated at right angles to path 22. When the ball hits point 24, it is illustrated as again reversing direction in following path 28 towards point 30. When the ball hits point 30, it illustratively follows path 32 towards point 34 and then along path 36 to a point where the ball 10'' comes to rest. The entire illustrated path is but one of enumerable different paths which the ball might take.

Having thus described my invention, I claim:

1. A ball fabricated of an elastomeric material for the purpose of throwing for bouncing, the surface of said ball being entirely covered with a plurality of elongated ridges and grooves which extend in a multiplicity of different directions, the peak of each ridge defining a line of substantial length which, when the ball is thrown and strikes a hard surface, will dictate the direction of bounce of the ball, said peaks being relatively sharp, said peaks being spaced apart a distance such that when the ball is thrown against a hard surface one of the ridges will make line contact with the surface and the direction of bounce of the ball will be unpredictable.

2. A ball as defined in claim 1, further characterized in that said ball has a generally elliptic configuration.

* * * * *